US006183602B1

(12) United States Patent
Iwata et al.

(10) Patent No.: US 6,183,602 B1
(45) Date of Patent: Feb. 6, 2001

(54) TWIN WIRE FORMER DEWATERING DEVICE FOR A PAPER MACHINE

(75) Inventors: Hiroshi Iwata; Makio Hasuike; Kazuhiro Naito; Masanobu Matsumoto, all of Hiroshima-ken (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/136,299

(22) Filed: Aug. 19, 1998

(30) Foreign Application Priority Data

Sep. 5, 1997 (JP) ..... 9-240803

(51) Int. Cl.[7] ..... D21F 1/54
(52) U.S. Cl. ..... 162/301; 162/300; 162/352
(58) Field of Search ..... 162/300, 301, 162/352

(56) References Cited

U.S. PATENT DOCUMENTS 5,061,347 * 10/1991 Bubik et al. ..... 162/301
5,078,835 * 1/1992 Schiel et al. ..... 162/352
5,116,477 * 5/1992 Bubik et al. ..... 162/301
5,262,010 * 11/1993 Bubik et al. ..... 162/301
5,437,769 * 8/1995 Bando et al. ..... 162/301
5,660,689 * 8/1997 Bartelmuss ..... 162/352
5,871,617 * 2/1999 Iwata et al. ..... 162/301

* cited by examiner

*Primary Examiner*—Karen M. Hastings
(74) *Attorney, Agent, or Firm*—Sughrue, Mion, Zinn, Macpeak & Seas, PLLC

(57) ABSTRACT

In order to render a twin wire former for a paper machine more applicable to an appropriate dewatering pressure state with respect to widely used paper formation conditions, there is provided a dewatering device including a plurality of dewatering blades that face a gap for paper formation through the wires constituting closed loops. The dewatering blades comprise a pressure adjustment unit for operating the dewatering blades in a direction close to or away from a wire and an angle adjustment unit for swinging the dewatering blades in a wire running direction, which are operationally associated with each other. The angle formed between an active plane of the dewatering blades and the wires is externally adjustable by the angle adjustment unit.

11 Claims, 6 Drawing Sheets

A : WEDGE-SHAPED DEWATERING BLADE

B : PRESSING BY MOVABLE TUBE

C : EMPLOYMENT OF CONVENTIONAL DEWATERING BLADE

TWIN WIRE FORMER DEWATERING DEVICE FOR A PAPER MACHINE

BACKGROUND OF THE INVENTION

1. Field of the Invention

The present invention relates to a twin wire former for a paper machine, and particularly to a twin wire former dewatering device for dewatering with dewatering blades.

2. Description of the Prior Art

Conventionally, a twin wire former is known as a paper layer forming apparatus for a paper machine. In the conventional twin wire former, two wires form a closed loop, respectively. As the paper stock (the pulp suspension) supplied between the wires travels along with wires, it is gradually dewatered by various dewatering devices including various dewatering elements. A paper layer or a fiber mat is thus grown which is further dewatered by a press part subsequent to the twin wire former to form a wet paper.

An example of the conventional twin wire former is schematically shown in FIG. 5, and will be referred to hereinafter.

In FIG. 5, a paper stock 7 filled in a headbox 6 is injected from the headbox 6 to a wedge-shaped gap 5 which is formed by a top wire 1 and a bottom wire 2.

FIG. 5 shows the top wire 1 on the left and the bottom wire 2 on the right. The top wire 1 is operated by a drive roller (not shown) and guided by a forming roll 3 and guide rolls 31A to 31D, while the bottom wire 2 is typically operated by a drive motor (not shown) and guided by a breast roll 4, a suction couch roll 12, guide rolls 32A to 32*e* and the like. In FIG. 5, the wires 1 and 2 are rotated in the directions indicated by the arrows. The above mentioned gap 5 is formed between the wires 1 and 2. The paper stock 7 is injected to the gap 5 from a headbox 6. The paper stock 7 is dewatered by various dewatering devices 14, 23, 15 and 11 to form paper web 13 while running along with the wires 1 and 2 in the gap 5 at the same rate as the wires.

A first dewatering device 14 on which a plurality of dewatering blades 9 are formed so as to be spaced apart from each other is provided at the bottom wire. 2 downstream from the forming roll 3 and the breast roll 4. The plurality of dewatering blades 9 contact, at the top ends thereof, the inside back surface of the bottom wire 2. The bottom wire 2 and the top wire 1 have a predetermined curvature (radius R) and are arranged so that the gap 5, formed between the bottom wire 2 and the top wire 1, gradually converges downstream.

Accordingly, while the paper stock 7 passing through the first dewatering device 14 travels within the gap 5 which gradually converges at the predetermined curvature (radius R), a dewatering process is performed at both sides (the sides of the bottom wire 2 and the top wire 1) of the paper stock by dewatering pressure generated by the plurality of dewatering blades to gradually form a fiber mat.

Second dewatering devices 23 and 15 are mounted at the downstream side of the first dewatering device 14. The second devices 23 and 15 are arranged so as to face each other over the top wire 1, the paper stock 7 and the bottom wire 2; the device 23 is provided at the top wire 1, and the device 15 is provided at the bottom wire 2.

FIG. 6 is an enlarged view showing an essential portion of the dewatering devices 23 and 15. The device 23 includes a plurality of dewatering blades 20 mounted so as to be spaced apart from each other on the device body 23A. The dewatering blades 20 are fixed by mounting portions 23B of the device body 23A. Each of the dewatering blades 20 is formed as a wedge-shaped type dewatering blade having a flat plane 20A and a slanted portion 20B.

The flat plane 20A is formed inside the loop of the top wire 1 and is arranged so as to contact the back surface of the top wire 1 to support the top wire 1. The slanted portion 20B is formed at a wire entering side (at the upstream side of the wire running direction) relative to the flat plane 20A so as to gradually slope away from the top wire 1 toward the upstream of the wire running direction.

A wedge-shaped clearance 20*c* is thus formed between the slant portion 20B and the top wire 1. The slant portion 20B has an angle θ referred to as a wedge angle.

The dewatering device 23 faces, over the wires, a dewatering device 15 provided with a plurality of dewatering blades 21 spaced apart from each other on the device body 15A. The dewatering blades 21 depress the back surface of the bottom wire 2, and the pressure applied by the dewatering blades 21 is externally adjustable by application of fluid pressure during operation of the paper machine.

Accordingly, each dewatering blade 21 is attached to a base 22 of the dewatering device 15, and the base 22 can be moved in a direction such that the bottom wire 2 and the device body 15A are brought close to or away from each other. The pressure applied to the bottom wire 2 by the dewatering blade 21 is adjustable by controlling fluid pressure, such as the air pressure and the hydraulic pressure, within a tube 24 formed between the base 22 and the device body 15A.

Such a pressure adjustment by means of the dewatering blade 21 allows the dewatering pressure generated in the paper stock 7, pinched between the top wire 1 and the bottom wire 2, to be controlled.

Referring again to FIG. 5, a third dewatering device 11, also called a suction box, is further provided inside the loop of the bottom wire 2 downstream from the second dewatering device 23. The third dewatering device 11 and a suction couch roll 12 dewater the paper stock 7 by vacuum to form a paper web which is securely conveyed onto the bottom wire 2 and transferred by a suction pick-up roll (not shown) to a press part subsequent to the wire part.

Conventionally, the second dewatering devices 23 and 15 adjust the dewatering pressure generated between the wires 1 and 2 by varying the pressure applied by the dewatering blades 21 of the dewatering device 15. However, there is a problem in that the dewatering pressure is adjusted in a narrow range in such a conventional pressure adjustment system, and it is difficult to make all the paper producing conditions adjustable for the appropriate dewatering pressure state.

Consequently, the dewatering pressure is normally set to achieve the most frequently used paper type with high quality. However, in this case, variation of the paper producing conditions would force the dewatering operation out of the optimum with the result that deteriorated paper quality must be more or less accepted, and it becomes difficult to prepare various types of low production volume paper.

Further, an intensive study has revealed that with a wedge-shaped dewatering blade, such as the above-mentioned blade 20, the dewatering pressure is greatly regulated by the wedge angle θ. Therefore, with the wedge-shaped dewatering blade, adjustment of the wedge angle would enable an appropriate dewatering pressure state to be obtained in a wide range of paper producing conditions.

SUMMARY OF THE INVENTION

The present invention has been made in view of the aforementioned problems, and it is an object of the present invention to provide a twin wire former dewatering device for a paper machine capable of adjusting a suitable dewatering pressure in a wide range of paper producing conditions.

To achieve the above-mentioned object, according to one aspect of the present invention, there is provided a twin wire former dewatering device for a paper machine. In a twin wire former for a paper machine, including two wires forming closed loops, respectively, arranged so as to face each other and form a gap for paper formation, the two wires pinch paper stock supplied to the gap for paper formation therebetween and convey the paper stock while running, a twin wire former dewatering device for the paper machine comprises: a plurality of dewatering blades which are arranged inside one of the closed loops; and wires for defining the closed loops where the dewatering blades are arranged, the gap for paper formation being formed by the wires, wherein each of the dewatering blades is provided with an active plane at the wires, an angle formed between the active plane and the wires being adjustable by means of an angle adjustment unit.

In the dewatering device according to the present invention, the dewatering blade has a wedge-shape, comprising: a supporting surface for supporting said wire while contacting the wire; and a slanted portion for defining, in association with the wire surface, a wedge-shaped clearance diverging from the wire surface toward the upstream of the wire running direction, the slanted portion being formed at the wire entering side of said supporting surface, the supporting surface and the slanted portion serving as the active plane. Preferably, the angle adjustment unit adjusts an angle of the slanted portion.

The angle adjustment unit further preferably adjusts the angle by use of fluid pressure.

Still further, the dewatering device of the present invention comprises an opposing dewatering blade provided substantially at a position facing the dewatering blade across the gap for paper forming, the opposing dewatering blade being arranged as a wedge-shaped dewatering blade; the wedge-shaped dewatering blade including; a supporting surface for contacting the wire to support the wire; and a slanted portion formed at the wire entering side of the supporting surface, for defining a wedge-shaped clearance, the wedge-shaped clearance diverging from the wire surface toward the upstream of the wire running direction. Advantageously, there is formed a pressure adjustment unit for externally adjusting pressure acting on the paper stock by the dewatering blade.

Furthermore, the opposing dewatering blade provided at a position facing the dewatering blade over the gap for paper formation may also be formed as a scraping-type dewatering blade.

According to another aspect of the present invention, there is provided a twin wire former for a paper machine, which comprises: a pair of wires formed in closed loop shapes, respectively, arranged so that at least a part of the wire portions confront each other and travel along closed paths, for defining a gap for paper forming that receives the paper stock between the confronting wires; means for rotatably supporting the wires to guide same; and a dewatering means including a plurality of dewatering devices for dewatering, through the pair of wires, the paper stock supplied to the gap for paper forming, the plurality of dewatering devices being formed inside the closed loops so as to contact the back surfaces of the confronting wire portions, wherein at least one of the dewatering devices includes a plurality of dewatering blades that are formed inside one of the closed loops, the dewatering blades facing the gap for paper formation through the wire portion for defining the closed loops, each of the dewatering blades having an active plane on said wire, an angle formed between the active plane and the wire being adjustable by means of an angle adjustment unit.

In such a twin wire former for a paper machine, the plurality of dewatering devices, including the dewatering means, comprise a first dewatering device, a second dewatering device and a third dewatering device that are arranged in order from the upstream along the confronting wire portion with respect to the wire running direction. It is preferable that at least one of the dewatering devices is the second dewatering device. Further, in such a twin wire former for the paper machine, at least one of the dewatering devices is the first and/or third dewatering device.

BRIEF DESCRIPTION OF THE DRAWINGS

With reference to the accompanying drawings.

DESCRIPTION OF THE PREFERRED EMBODIMENTS

Figure 1A:
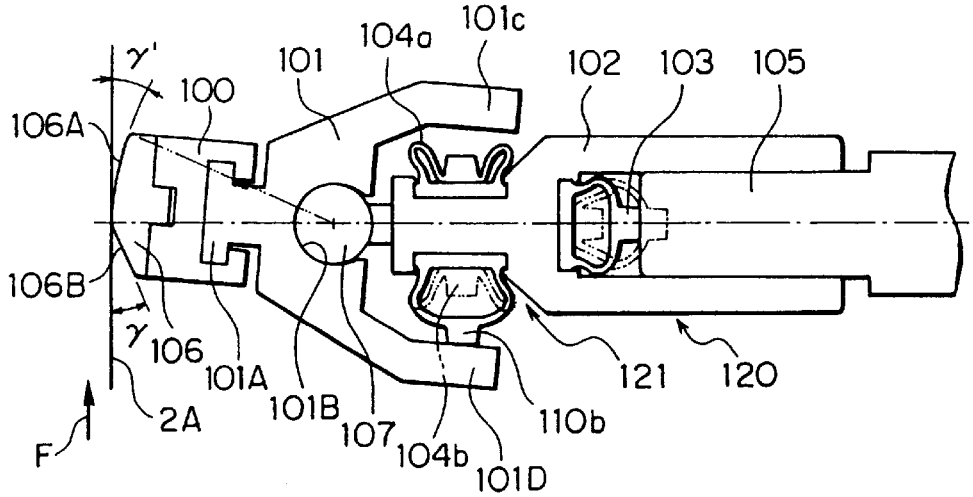
FIGS. 1A, 1B and 1C are schematic enlarged sectional views of an essential portion of a twin wire former dewatering device for a paper machine according to a first embodiment of the present invention illustrating different adjustment states of an angle formed between a dewatering blade and a wire.

Preferred embodiments of the present invention will now be described with reference to the drawings. The same reference numerals designate the same or corresponding parts throughout the drawings.

Figure 5:
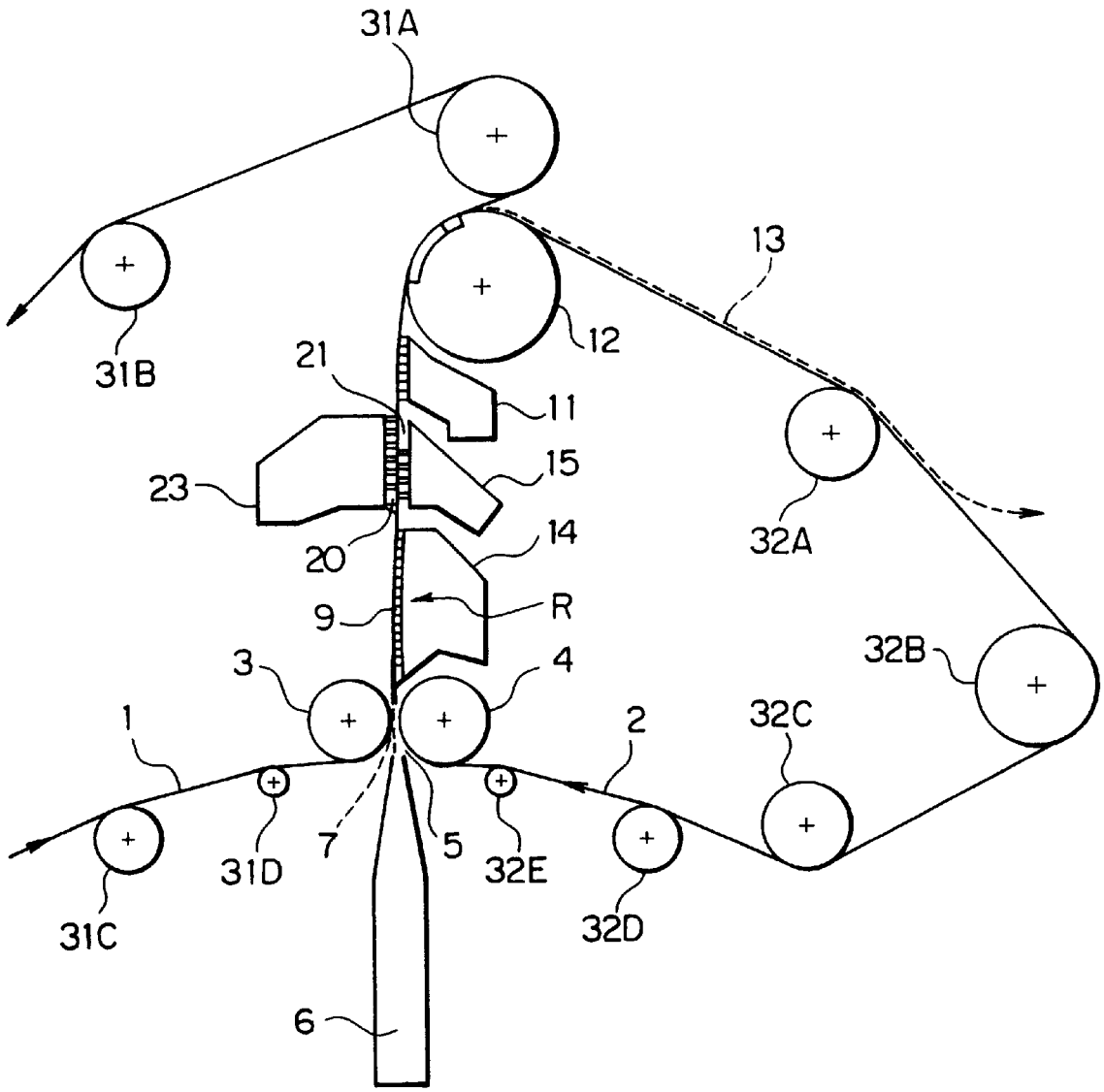
FIG. 5 PRIOR ART
FIG. 5 is a schematic view illustrating a structural example of a prior art twin wire former dewatering device for a paper machine.

It is noted that although the type of twin wire former dewatering device for a paper machine shown in FIG. 5 is employed in the present invention, the device according to the present invention can be implemented in every type of twin wire former for a paper machine, including the one set forth in the claims of the present invention. Further in the following embodiments of the present invention, a so-called second dewatering device is applied in the type of the twin wire former dewatering device for the paper machine shown in FIG. 5. However, as is obvious to those skilled in the art, a so-called first and/or third dewatering device is also applicable. In the present invention, although a first, second and third dewatering devices are arranged in order from the upstream of the wire running direction, these positions are interchangeable.

FIG. 1A is a schematic sectional view showing a twin wire former dewatering device for a paper machine according to a first embodiment of the present invention. Referring to FIG. 1A, the twin wire former (not shown) using the dewatering device comprises a headbox, a top wire, a bottom wire and the like as previously described in FIG. 5. The top and bottom wires form loops, and a gap (a gap for paper formation) is formed between the wires, to which the paper stock filled in the headbox is injected.

The top wire is guided by a forming roll, guide rolls and the like in the same manner as in the twin wire former previously mentioned in FIG. 5, while the bottom wire is guided by a breast roll, a suction couch roll, guide rolls and the like. Each of the wires is rotated so as to transfer the paper stock in the gap to a desired direction (in the upper direction in FIG. 5). The paper stock injected into the gap from the headbox is pinched in the gap, travels at substantially the same rate together with the wires, and is dewatered to form a paper layer.

The gap for the paper formation converges toward the downstream of the wire running direction. At the upstream of the gap for paper formation, each of the wire loops is given a curvature (radius R) by the forming roll and the breast roll. As described above, from the upstream portion of the gap for the paper formation are formed in order a first dewatering device, a second dewatering device, a third dewatering device, a suction couch roll and the like, which dewater the paper stock and form a paper layer.

A detailed explanation will now be made using the same numerals as those given to explain the conventional twin wire former shown in FIG. 5. Subsequent to dewatering by a first dewatering device 14 and a second dewatering device 23, the paper stock is dewatered by vacuum from a third dewatering device 11, also called a suction box, provided inside the loop of the bottom wire 2 and by a suction couch roll 12, and a paper web is formed. The thus obtained web is conveyed on the bottom wire 2, and transferred to the subsequent press part by a suction pickup roll (not shown).

In such a twin wire former for a paper machine, a dewatering device 15 is arranged so as to face the second dewatering device 23 at a location where the second dewatering device is arranged. According to this embodiment of the present invention, however, there is provided a new dewatering device as an alternative to the dewatering device 15 that faces the second dewatering device 23.

Figure 1B:
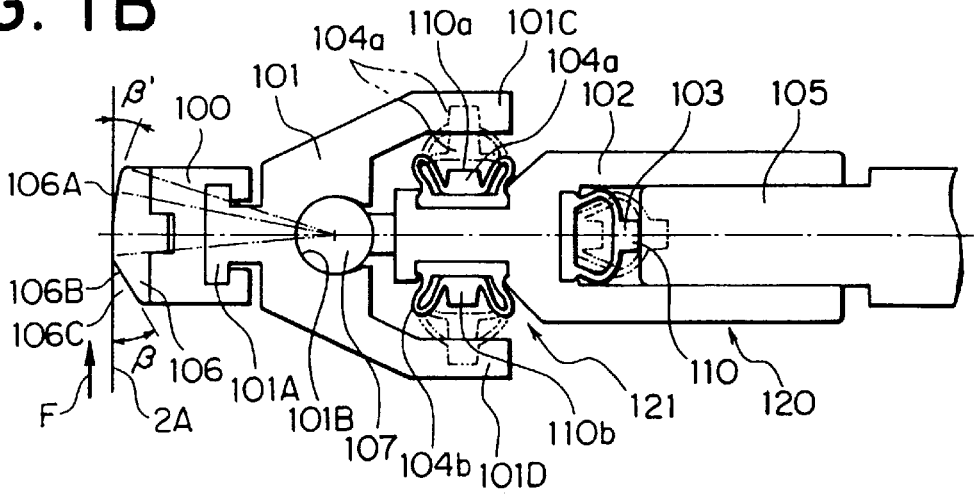

The dewatering device of the present invention is provided with a plurality of dewatering blades 100 which have the same construction as the dewatering blades shown in FIG. 1B spaced apart from each other in the wire running direction on the device body (not shown). Each dewatering blade 100 is supported by a base 105 which is protrusively mounted on the dewatering device body (not shown) through a first movable member 101 and second movable member 102 extending in the width direction of the wire.

In other words, the second movable member 102 is attached over the base 105, while being guided by the outer surface of the base 105, to thereby be capable of being moved close to or away from the outer surface 2A (a surface along the running line of the paper stock 7) of the bottom wire 2. At the tip of the second movable member 102 is mounted, for example, a cylindrical shaft 107 extending in the width direction of the wire; and a cylindrical groove 101B is formed in the first movable member 101 to slidably engage the shaft. With this arrangement, the first movable member 101 is supported so as to be rotateable about the axis of the shaft 107.

A T-shaped dovetail groove is formed at the top end portion of the dewatering blade 100, i.e., the end portion of the first movable member 101. A corresponding tip portion 101A of the first movable member 101 is engaged with the dovetail groove to allow the dewatering blade 100 to be integrally contacted with the first movable member 101. Also, the dewatering blade 100 is moved in the paper width direction relative to the first movable member 101, allowing the dewatering blade 100 to be inserted into and removed from the first movable member 101.

Further, the dewatering blade 100 has a blade body 106 integrally jointed thereto at the tip. The first movable member 101 can rotate about the shaft 107, enabling the dewatering blade 100 to rotate together with the blade body 106 with respect to the running direction of the paper stock 7.

The blade body 106 has a surface (referred to as an active plane) facing the back surface 2A of the bottom wire 2, constituting a bottom wire contact surface 106A, that contacts the bottom wire 2, and a slanted portion 106B at an angle with the bottom wire contact surface 106A. The dewatering blade 100 according to the present invention is formed as a wedge-shaped dewatering blade.

Specifically, a bottom wire contact surface (referred to as simply contact surface hereinafter) 106A that contacts the bottom wire 2 to support the bottom wire 2 is provided on active plane of the blade body 106 at the wire exit side (the downstream side of the wire running direction). A slanted portion 106B that increasingly diverges from the bottom wire 2 toward the upstream of the wire running direction is formed at the upstream side of the contact surface 106A, i.e., at the wire entering side (the upstream side of the wire running direction) of the active plane of the blade body 106. A wedge-shaped clearance 106C is formed between the slanted portion 106B and the bottom wire 2.

A resilient tube 103 is interposed between the base 105 and the second movable member 102. The tube 103, fixed to the second movable member 102, includes a head 110 that may be pressed against the base 105. The tube 103 has a fluid pressure therein such as air pressure or hydraulic pressure that may be adjusted by a fluid pressure pumping unit described later. Depending upon the inner pressure of the tube 103, the head 110 is pressed against the base 105, allowing the second movable member 102 and thus the first movable member 101 to move toward the base 105. In the Figure, when the inner pressure of the tube 103 increases (a state indicated by the broken line), while the head 110 is being pressed by the base 105, the second movable member 102 moves away from the base 105. In other words, the second movable member 102 may move in the direction to approach the running line of the paper stock 7. On the other hand, when the inner pressure of the tube 103 is reduced (a state indicated by the solid line), since the head 110 is decreasingly pressed against the base 105, the second movable member 102 moves close to the base 105. That is, the second movable member 102 may move in a direction away from the running line of the paper stock 7.

When the second movable member 102 is moved in a direction away from the running line of the paper stock 7, the dewatering blade 100 is also moved concurrently, and the pressure acting on the paper stock 7 may thereby be adjusted. In order to achieve such a condition, a pressure adjustment unit 120 is constructed of the second movable member 102 movable to the base 105, the resilient tube 103 and the fluid pressure pumping unit (not shown) for adjusting the inner pressure of the resilient tube 103.

Further, a pair of resilient tubes 104*a* and 104*b* are formed between the cap-shaped second movable member 102 and first movable member 101. These tubes 104*a* and 104*b* are also formed upstream and downstream of the wire running direction with respect to the axis of the second movable member 102 and are fixed to the second movable member 102. Convex heads 110*a* and 110*b* are formed on the tubes 104*a* and 104*b*, respectively. The respective heads 110*a* and 110*b* can be extended, as indicated by a broken line, from a sunken state as indicated by a solid line in FIG. 1B, so the heads 110*a* and 110*b* may press against the inner surfaces of the arms 101C and 101D formed at the first movable member 101.

The inner fluid pressure such as air pressure, hydraulic pressure and the like, of the tubes 104*a* and 104*b* may be individually adjusted by the fluid pressure pumping unit described later. Depending upon the inner pressure of the tubes 104*a* and 104*b*, the heads 110*a* and 110*b* may be pressed against the arms 101C and 101D, thus allowing the first movable member 101 to swing with respect to the second movable member 102.

When the inner pressure of the tube 104*b* increases (it is assumed that the inner pressure of the tube 104*a* is minimized or reduced to some extent), as shown in FIG. 1A, the arm 101D will be pressed. The first movable member 101 then rotates about the shaft 107, and moves the dewatering blade 100 to the downstream of the flow direction of the paper stock 7 (the running direction of the wire 2, see the arrow F in the Figure).

Figure 1C:
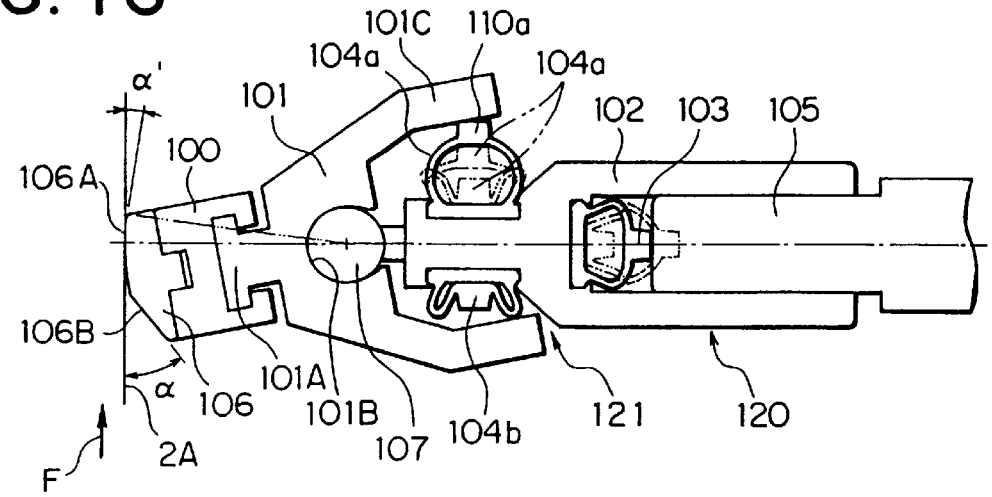

On the contrary, when the inner pressure of the tube 104*a* increases (it is assumed that the inner pressure of the tube 104*b* is minimized or reduced to some extent), as shown in FIG. 1C, the arm 101C will be pressed. The first movable member 101 then rotates about the shaft 107, and moves the dewatering blade 100 to the upstream of the flow direction of the paper stock 7 (the running direction of the wire 2).

Further, when the inner pressure of both tubes 104*a* and 104*b*is kept in balance, as shown in FIG. 1B, the first movable member 101 is not inclined either backwards or forwards, i.e., it is in a neutral state, thus resulting in the dewatering blade 100 also being in a neutral state.

Accordingly, when the dewatering blade 100 swings, the angle of the active planes 106A and 106B of the dewatering blade 100 (blade body 106) relative to the wire running direction (the paper stock flow direction) is adjusted. Specifically, an angle (wedge angle) formed between the slanted portion 106B and the bottom wire 2 is adjusted.

Therefore, an angle adjustment unit 121 for externally adjusting the angle formed between the active plane of the dewatering blade 100 and the wire 2 is constituted by a first movable member 101 capable of swinging with respect to the base side (the side of the second movable member 102), the resilient tubes 104*a* and 104*b*, and a fluid pressure pumping unit, described later, for adjusting the inner pressure of the tubes 104*a* and 104*b*.

Figure 2:
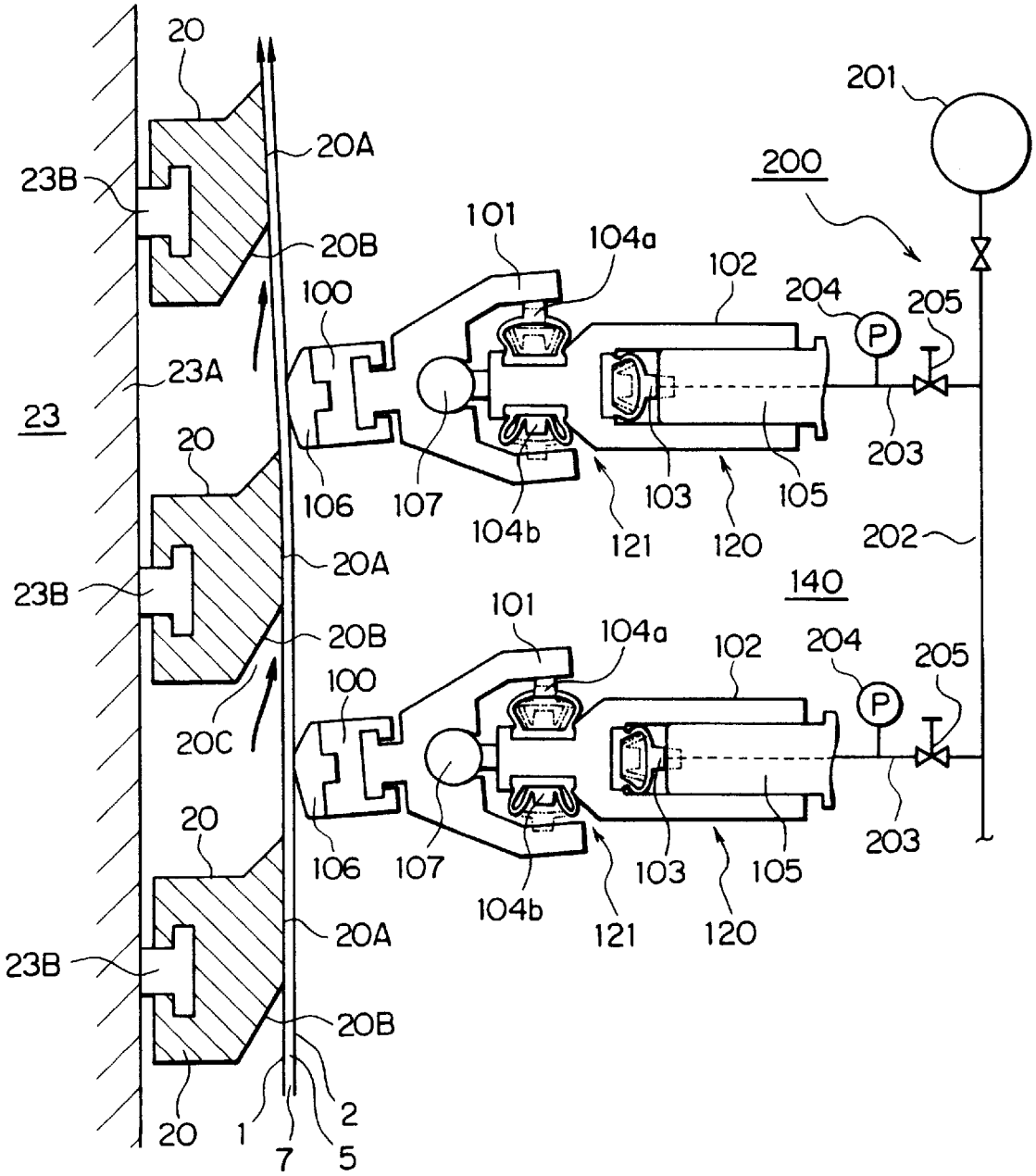
FIG. 2 is a schematic sectional view illustrating an essential portion of a twin wire former dewatering device for a paper machine according to a second embodiment of the present invention.

FIG. 2 schematically illustrates an example of the above mentioned fluid pressure pumping unit. In FIG. 2, the fluid pressure pumping unit 200 comprises a pressure source 201 which may be, for example, a hydraulic pressure pump or an air compressor, a supply header 202 for connection to the pressure source 201, and branch lines 203 branched from the supply header 202 corresponding to each of the tubes 103. Each of the branch lines 203 connects pressure gauges 204 for gauging the inner pressure of the corresponding tube 103 to pressure adjustment valves 205 serving as pressure reducing valves or the like. The inner pressure of the tube 103 is adjusted by opening/closing the pressure adjustment valves 205. Further, the branch lines (not shown) extend from the supply header 202 so as to correspond to the respective tubes 104*a* and 104*b*, and each of the branch lines is connected to the same element as the above, pressure gauges 204 and the pressure adjustment valves 205.

The opening/closing of the pressure adjustment valve connected to the respective branch line can be manually conducted by a person skilled in the art of producing a paper by reading the corresponding pressure gauges. Alternatively, he can operate remotely at a centralized control board (not shown) by electrically connecting the respective pressure gauges and the respective pressure adjustment valve to the centralized control board.

According to this embodiment of the present invention, a wedge angle $\gamma$ (FIG. 1A) is held in a state where the inner pressure of the tube 104*b* is increased more than that of the tube 104*a*; a wedge angle $\beta$ (FIG. 1B) in a state where the inner pressures of the tubes 104*a* and 104*b* are kept in balance; and a wedge angle $\alpha$ (FIG. 1C) in a state where the inner pressure of the tube 104*a* is increased more than that of the tube 104*b*. In comparing the above three wedge angles, the relationship $\theta<\beta<\alpha$ can be obtained. Therefore, the wedge angle is adjustable in a wide range during operation, due to the adjustment of the inner pressure of the tubes 104*a* and 104*b* of the angle adjustment unit 121.

A bottom wire contact surface 106A serving as an active plane of the blade body 106 of the present invention is formed with a convex shape at the wire 2 side. When the blade body 106 is employed in reverse with respect to the flow direction (the running direction of the wire 2) of the paper stock 7, in other words, when the paper stock 7 is made to run in a reverse direction to the arrow F in FIG. 1A, the wire entering side of the bottom wire contact surface 106A (in this case, the upper side of the contact surface 106A is made a wire entering side in FIGS. 1A to 1C) separates from the wire 2. A wedge-shaped clearance 106C is then formed between the contact surface 106A and the bottom wire 2. In this case, the wedge angles are represented as angles $\alpha'$, $\beta'$ and $\gamma'$ formed between the contact surface 106A and the bottom wire 2.

According to the first embodiment of the present invention, since a twin wire former dewatering device for a paper machine has the above-mentioned arrangement, the fluid pressure of the tubes 104*a* and 104*b* of the angle adjustment unit 121 is adjusted and accordingly, the angle of the active planes 106A and 106B of the dewatering blade 100 can be adjusted sufficiently in a given range (e.g., the area shown in FIGS. 1A to 1C). The wedge angle of the blade body 106 of the dewatering blade 100 can be freely adjusted in a range of, e.g., $\gamma$ to $\alpha$.

Figure 4:
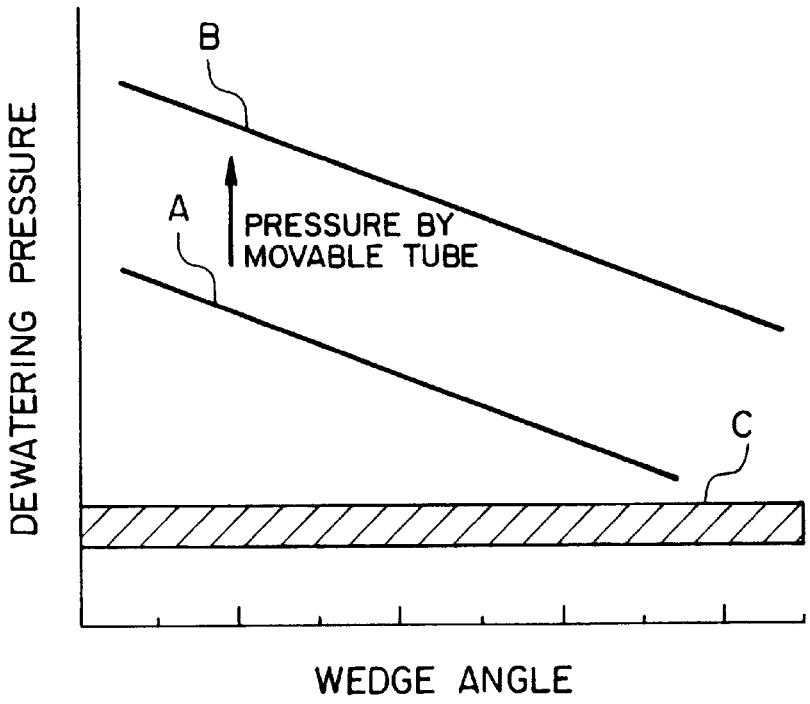
FIG. 4 is a graph showing characteristics of the operating principle according to the present invention.

As can be seen from above, when the wedge angle is adjusted, the dewatering pressure of the paper stock 7 is also adjusted. That is, as shown in FIG. 4, the dewatering pressure level of a conventional dewatering blade (a non-wedge-shaped dewatering blade without a slanted portion) is indicated by the zone C. On the other hand, a wedge-shaped dewatering blade such as the dewatering blade 100 indicated by line A of FIG. 4 makes it possible to increase the dewatering pressure. Furthermore, the dewatering pressure of the wedge-shaped dewatering blade greatly depends upon the wedge angle. The larger the wedge angle, the less the dewatering pressure. In other words, the angle adjustment unit 121 adjusts the wedge angle of the dewatering blade 100, and is thereby capable of adjusting the dewatering pressure in a wide range.

Also, the dewatering blade 100 (the blade body 106) of the present invention makes it possible to control the pressure acting on the paper stock 7 by adjusting the fluid pressure of the tube 103 in the pressure adjustment unit 120. As indicated by line B in FIG. 4, the pressure applied by this movable tube 103 enables the dewatering pressure to increase more than when no pressure is applied, as indicated by line A.

Accordingly, the combination of adjustment of the wedge angle and adjustment of the pressure applied by the tube 103 allows the dewatering pressure to be adjusted in an extremely wide range between the line A and the line B.

Such dewatering blades 100 of the present invention are arranged in a running direction of the wires 1 and 2, that is, in a flow direction of the paper stock 7. The wedge angle and the pressure are adjusted while each of the dewatering blades 100 is rotated or travels back and forth through externally applied fluid pressure during operation of the machine, and any particular pressure profile can be easily obtained (the dewatering pressure distribution in the flow direction of the paper stock 7).

Accordingly, since the dewatering pressure profile is readily externally adjustable, the optimal conditions against variation of the volume and concentration of the paper products and the like can be obtained. The quality of the paper can also be improved, and specifically various types of paper with low production volumes can be sufficiently prepared.

Further, since the dewatering blade 100 of the present invention can be inserted into and removed from the first movable member 101 by moving it in the width direction of the paper, another dewatering blade 100 with a different shape can be easily attached to the blade body 106, and the wedge angle (initial angle) in the neutral state as illustrated in FIG. 1B can also be easily varied. Further, it is advantageous that the initial angle may be freely set.

When only the angle adjustment unit 121 for externally adjusting the angle formed between the active plane of the dewatering blade 100 and the wire 2 is incorporated, the dewatering pressure may be adjusted to some extent in a wide range. Therefore, the pressure adjustment unit 120 for adjusting the pressure applied to the paper stock 7 by the dewatering blade 100 may be removed.

Referring now to FIG. 5, according to the present invention, the dewatering device having the dewatering blades 100 is formed so as to face another optional dewatering device such as the second dewatering device 23, thereby enabling the dewatering performance to be further improved. Hereinbelow will be described a structural example of a combination of the dewatering device of the present invention and a dewatering device opposed thereto (referred to as opposing dewatering device hereinafter) as a second embodiment and third embodiment of the present invention.

Figure 6:
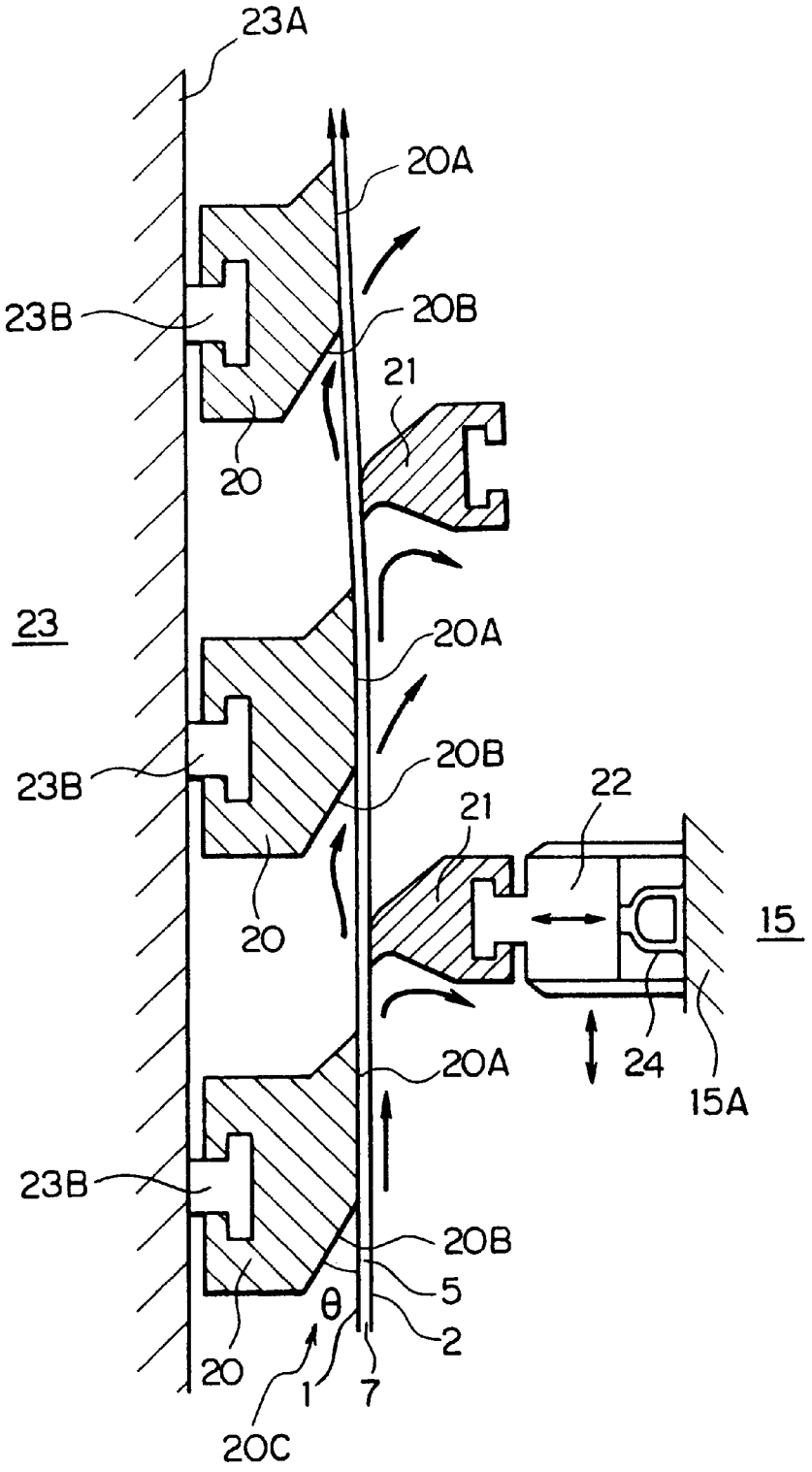
FIG. 6 PRIOR ART
FIG. 6 is a schematic sectional view illustrating an essential portion of a conventional twin wire former dewatering device for a paper machine.

According to the second embodiment of the present invention, as is illustrated in FIG. 2, a dewatering device 140 having a plurality of dewatering blades 100, as previously described in the first embodiment of the present invention, is provided so as to face a dewatering device 23 having wedge-shaped dewatering blades as described as prior art (see FIG. 6).

The opposing dewatering device 23 facing the dewatering device 140 of the present invention is provided with a plurality of dewatering blades (opposing dewatering blades) 20 that are attached to the device body 23A spaced apart from each other. Each of the dewatering blades 20 is attached to a mounting portion 23B of the device body 20A, and arranged as a wedge-shaped dewatering blade having a flat plane 20A and a slanted portion 20B. Although the slanted portion 20B extends substantially in a straight line in the Figure, it goes without saying that the slanted portion 20B may have a curved surface.

The flat plane 20A is arranged inside the loop of the top wire 1, contacting the top wire 1 so as to support it. The slanted portion 20B is formed at the wire entering side (upstream of the wire running direction) rather than the flat plane 20A so as to be away from the top wire 1 toward the upstream of the wire running direction. A wedge-shaped clearance 20C is thus formed between the slanted portion 20B and the top wire 1.

It is noted that a pressure adjustment unit 120 and an angle adjustment unit 121 provided for each dewatering blade 100 of the dewatering device 140 of the present invention, are arranged in the same manner as the first embodiment of the present invention so a detailed description will be omitted here.

With such an arrangement, the pressure adjustment unit 120 provided for each of the dewatering blades 100 of the dewatering device 140 of the present invention adjusts not only the pressure applied to the paper stock 7 by each of the dewatering blades 100, but also the pressure applied to the paper stock 7 by the opposing dewatering blade 20 corresponding to the opposing dewatering device 23 in the vicinity of the dewatering blade 100. Besides such pressure adjustment by both the dewatering blades 100 and 20, an angle (a wedge angle) formed between the active plane of the dewatering blade 100 and the wire 2 is adjusted by the angle adjustment unit 121, and the dewatering pressure can be adjusted in a wide range during operation of the machine.

Accordingly, the combination of adjustment of the wedge angle and adjustment of the pressure applied by the tube 103 allows the dewatering pressure to be adjusted in an extremely wide range between the line A and the line B.

Next, a plurality of the dewatering blades 100 of the dewatering device 140 and a plurality of the dewatering blades 20 of the opposing dewatering device 23 are arranged in a running direction of the wires 1 and 2, respectively, that is, in a flow direction of the paper stock 7. The wedge angle and the pressure are adjusted while each of the dewatering blades 100 is rotated or travels back and forth through externally applied fluid pressure during operation of the machines, and therefore any particular pressure profile (the dewatering pressure distribution in the flow direction of the paper stock 7) can be readily obtained.

As a result, since the dewatering pressure profile is readily externally adjustable, the optimal conditions against variation of the volume and concentration of the paper products and the like can be realized, the quality of the paper can be improved, and various types of low production volume paper can be sufficiently obtained.

In particular, since the opposing dewatering blade 23 is formed as a wedge-shaped dewatering blade, the dewatering pressure level can be readily increased, and a wider range of dewatering pressure adjustments can be set. As a result, paper can be produced in a wider range under optimal dewatering pressure profiles, so that the quality of the paper can be improved. And the paper produced is more suitable for various types of low production volume paper.

Figure 3:
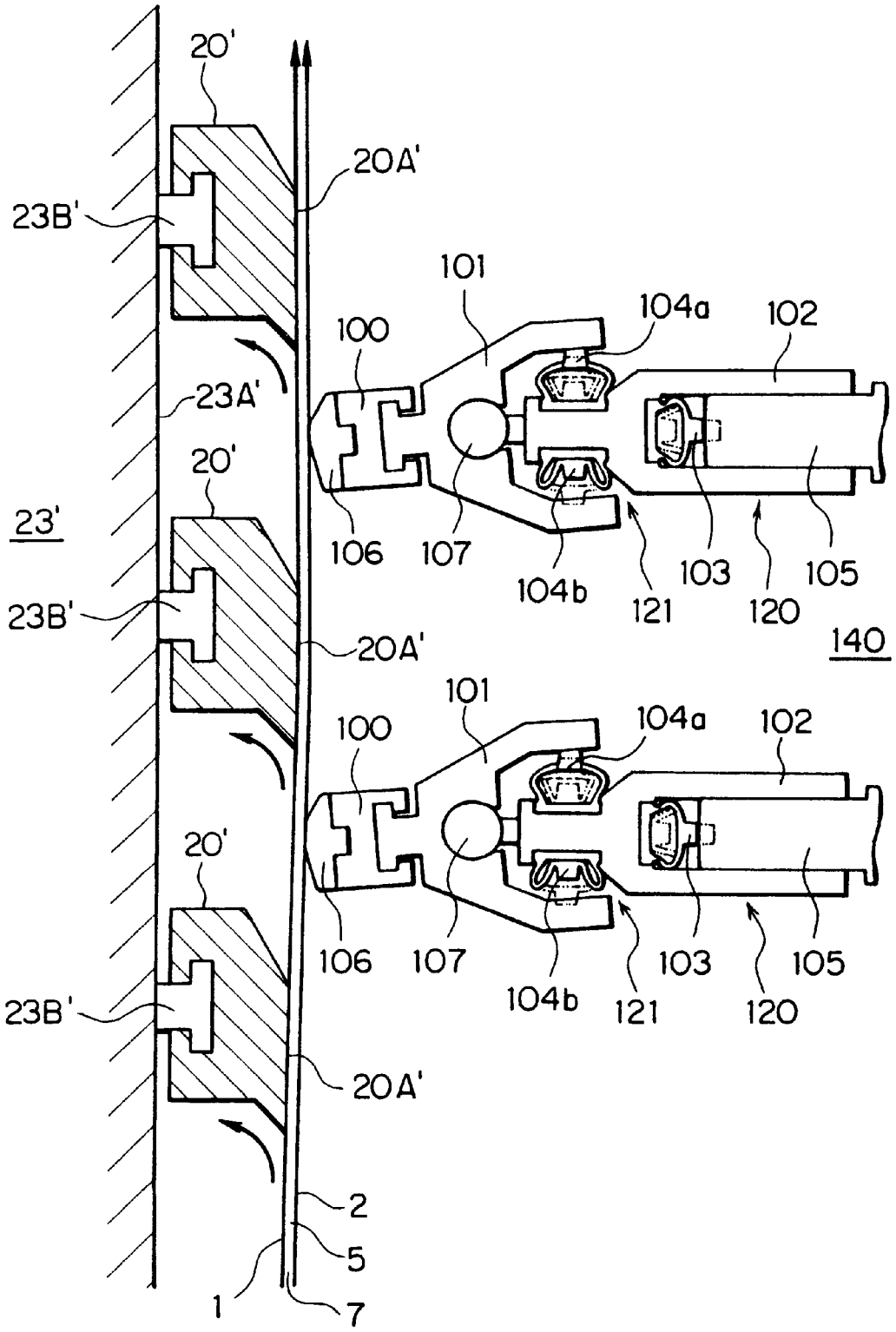
FIG. 3 is a schematic view illustrating an essential portion of a twin wire former dewatering device for a paper machine according to a third embodiment of the present invention.

According to a third embodiment of the present invention, as shown in FIG. 3, the dewatering device 140 having a plurality of the dewatering blades 100, described in the first embodiment of the present invention, is provided so as to face a dewatering device 23' having scraping-type dewatering blades 20' which are not wedge-shaped.

That is, the dewatering device 23' that faces the dewatering device 140 of the present invention is provided with a plurality of dewatering blades 20' mounted so as to be spaced apart from each other on the device body 23A'. These dewatering blades 20' are attached to the mounting portions 23B' of the device body 23A'. Each of the dewatering blades 20' is a scraping-type dewatering blade.

In other words, a wire supporting surface 20A' of the dewatering blade 20' is arranged inside the loop of the top wire 1, and contacted with the top wire 1 so as to support it. Unlike a wedge-shaped blade, the dewatering blade 20' does not have a slanted portion 20B at the wire entering side, and the wire entering side of the wire supporting surface 20A' is formed with an edge so that, as indicated by the arrows in FIG. 3, the edge-shaped portion is designed to scrape water from the paper stock 7.

It is noted that the dewatering blade 100 of the dewatering device 140 of the present invention is provided with a pressure adjustment unit 120 and an angle adjustment unit 121, arranged in the same manner as the first embodiment of the present invention so that a detailed description will be omitted here.

With such an arrangement, a pressure adjustment unit 120 provided at each of the dewatering blades 100 of the dewatering device 140 of the present invention adjusts not only the pressure applied to the paper stock 7 by each of the dewatering blades 100, but also the pressure applied to the paper stock 7 by the opposing dewatering blade 20' corresponding to the opposing dewatering device 23' in the vicinity of the dewatering blade 100. Besides such pressure adjustment by both the dewatering blades 100 and 20', an angle (a wedge angle) formed between the active plane of the dewatering blade 100 and the wire 2 is adjusted by an angle adjustment unit 121, and the dewatering pressure is adjustable in a wide range during operation of the machine.

Accordingly, referring to FIG. 4, the combination of adjustment of the wedge angle and adjustment of the pressure applied by the tube 103 allows the dewatering pressure to be adjusted in an extremely wide range between the line A and the line B.

Next, a plurality of the dewatering blades 100 of the dewatering device 140 of the present invention and a plurality of the dewatering blades 20' of the opposing dewatering device 23' are respectively arranged in a running direction of the wires 1 and 2, that is, in a flow direction of the paper stock 7. The wedge angle and the pressure are adjusted while each of the dewatering blades 100 is rotated or travels forward and backward through externally applied fluid pressure during operation of the machine, and therefore any particular pressure profile can be readily obtained.

As a result, since the dewatering pressure profile is readily externally adjustable, the optimal conditions against variation of the volume and concentration of the paper products or the like can be realized, the quality of the paper can be improved, and various types of low production volume paper can be sufficiently prepared.

As described above in detail, in a twin wire former dewatering device for the paper machine according to one aspect of the present invention, an angle formed between the active plane of the dewatering blade and the wire is externally adjusted through an angle adjustment unit. Accordingly, while the dewatering pressure is freely controlled in a wide range during operation of the paper machine, a dewatering pressure profile is readily externally adjustable. As a result, the optimal conditions against variation of the volume and concentration of the paper products and the like can be realized, the quality of the paper can be improved, and various types of low production volume paper can be sufficiently prepared.

In a twin wire former dewatering device for the paper machine according to another aspect of the present invention, since a dewatering blade is formed as a wedge-shaped dewatering blade, the dewatering pressure may be increased. In addition, adjustment of the dewatering pressure is further facilitated, and the external adjustment of the dewatering pressure profile is also further facilitated. Therefore, paper can be produced in an optimal dewatering profile with regard to different paper formation conditions, the quality of the paper can be improved, and various types of low production volume paper can be more reliably produced.

In a twin wire former dewatering device for the paper machine according to still another aspect of the present invention, an angle adjustment unit adjusts the above angle using fluid pressure. As a result, there is an advantage in that external angle adjustment is facilitated and the dewatering pressure profile is easily and securely adjustable externally.

In a twin wire former dewatering device in the paper machine according to a further aspect of the present invention, when the dewatering process is carried out by the dewatering blades having the angle adjustment units and the opposing dewatering blades that face thereto, the dewatering pressure profile is externally adjustable by the adjustment of the angle by means of the angle adjustment unit. As a result, paper can be produced in an optimal dewatering profile with regard to different paper formation conditions, the quality of the paper can be improved, and various types of low production volume paper can be reliably prepared.

Further, in a twin wire former dewatering device in the paper machine according to an aspect of the present invention, since the opposing dewatering blade is formed as a wedge-shaped dewatering blade, the dewatering pressure level may be readily increased. Further, the adjustment range of the dewatering pressure can be more widely set and paper can be produced in an optimal dewatering profile in a wider range, the quality of the paper can be improved, and paper is made more suitable for various types of low production volume paper.

It is, evident that there has been provided in accordance with the present invention, an apparatus which fully satisfies the aims and advantages heretofore mentioned. While the invention has been described in conjunction with preferred embodiments thereof, it is evident that many alternatives, modifications and variations will be apparent to those skilled in the art. Accordingly, it is intended that the invention embraces all such alternatives, modifications, and variations that fall within the spirit and broad scope of the appended claims.

What we claim is:

1. In a twin wire former for a paper machine, including two wires forming closed loops, respectively, arranged facing each other so as to cooperatively form a gap for paper formation, said two wires pinch therebetween paper stock therebetween supplied to the gap for paper formation and convey said paper stock while running, a the twin wire former dewatering device provided for the paper machine comprising:

a plurality of adjustable dewatering blades arranged inside one closed loop of said closed loops; and wherein each of said adjustable dewatering blades is provided with an active plane on the wires, an angle formed between said active plane and said wires being adjustable by means of an angle adjustment unit; and wherein each of said adjustable dewatering blades comprises:

a base;

a second movable member moveably supported by said base so as to move relative to said base in a direction towards and away from a wire portion traveling in the vicinity of said adjustable dewatering blade; and a first movable member supported by said second movable member so as to swing in a traveling direction of said wire portion to thereby adjust the angle formed between said respective active plane and said wires, and wherein said first movable member supports said adjustable dewatering blade.

2. A dewatering device as claimed in claim 1, wherein said angle adjustment unit is formed between said first movable member and said second movable member.

3. A dewatering device as claimed in claim 2, wherein said angle adjustment unit includes a resilient bag member.

4. A dewatering device as claimed in claim 3, wherein said bag member is a pair of tubes extending in a width direction of said wire over a tip portion of said second movable member.

5. A dewatering device as claimed in claim 1, further comprising a pressure adjustment unit formed between said base and said second movable member.

6. A dewatering device as claimed in claim 5, wherein said pressure adjustment unit includes a resilient bag member.

7. A dewatering device as claimed in claim 6, wherein said bag member of said pressure adjustment unit is a tube extending in a width direction of said wire.

8. A twin wire former dewatering device for a paper machine, the paper machine including two wires forming closed loops, respectively, arranged facing each other so as to cooperatively form a gap for paper formation, said two wires pinch therebetween paper stock therebetween supplied to the gap for paper formation and convey said paper stock while running, said twin wire former dewatering device comprising:

a plurality of adjustable dewatering blades arranged inside one closed loop of said closed loops, wherein each of said adjustable dewatering blades is provided with an active plane on the wires; and an angle adjustment unit which adjusts an angle formed between said active plane and said wires; and wherein each of said adjustable dewatering blades has a wedge-shape, comprising:

a supporting surface for supporting said wire while contacting said wire; and a slanted portion for defining, in associates with a wire surface, a wedge-shaped clearance diverging away from said wire surface toward the upstream of the wire running direction, said slanted portion being formed at the wire entering side of said supporting surface, said supporting surface and said slanted portion serving as said active plane; and wherein said angle adjustment unit adjusts an angle of said slanted portion; and wherein each of said adjustable dewatering blades further comprises:

a base;

a second movable member moveably supported by said base so as to move relative to said base in a direction towards and away from the wire portion traveling in the vicinity of said adjustable dewatering blade; and a first movable member supported by said second movable member so as to swing in a traveling direction of said wire portion to thereby adjust the angle formed between said respective active plane and said wires, and wherein said first movable member supports said adjustable dewatering blade; and wherein said angle adjustment unit is formed between said first movable member and said second movable member; and includes a resilient bag member which is a pair of tubes extending in a width direction of said wire over a tip portion of said second movable member; and wherein said twin wire former further comprises a pressure adjustment unit formed between said base and said second movable member.

9. A twin wire former dewatering device for a paper machine, the paper machine including two wires forming closed loops, respectively, arranged facing each other so as to cooperatively form a gap for paper formation, said two wires pinch therebetween paper stock therebetween supplied to the gap for paper formation and convey said paper stock while running, the twin wire former dewatering device comprising:

a plurality of adjustable dewatering blades arranged inside one closed loop of said closed loops, wherein each of said adjustable dewatering blades is provided with an active plane on the wires; and an angle adjustment unit which adjusts an angle formed between said active plane and said wires; and wherein each of said adjustable dewatering blades comprises:

a base;

a second movable member moveably supported by said base so as to move relative to said base in a direction towards and away from the wire portion traveling in the vicinity of said adjustable dewatering blade; and a first movable member supported by said second movable member so as to swing in a traveling direction of said wire portion to thereby adjust the angle formed between said respective active plane and said wires, and wherein said first movable member supports said adjustable dewatering blade.

10. The twin wire former dewatering device according to claim 9, wherein said angle adjustment unit operates to swing said first moveable member independently of a movement of said second moveable member relative to said base in the direction towards and away from the wire portion.

11. The twin wire former dewatering device according to claim 10, wherein said angle adjustment unit includes a resilient bag member for making swinging the first moveable member.

* * * * *